United States Patent [19]

Enrico

[11] Patent Number: 4,643,604

[45] Date of Patent: Feb. 17, 1987

[54] MAGNETIC PEN HOLDER

[76] Inventor: Bertin Enrico, Via Breno No. 7, Milan, Italy

[21] Appl. No.: 734,727

[22] Filed: May 16, 1985

[30] Foreign Application Priority Data

Sep. 4, 1984 [IT] Italy ..... 22513 A/84

[51] Int. Cl.[4] ..... B43K 41/00

[52] U.S. Cl. ..... 401/131; 401/52; 401/195; 206/371; 206/818; 211/69.5; 211/DIG. 1; 335/306

[58] Field of Search ..... D19/77, 78, 80, 81, D19/83, 84, 85; 206/214, 224, 371, 818; 211/69.1, 69.2, 69.5–69.7; 248/206.5, 346; 335/302, 303, 306; 401/52, 88, 131, 195

[56] References Cited

U.S. PATENT DOCUMENTS

| | | | |
|---|---|---|---|
| 2,693,788 | 11/1954 | Spatz | 211/69.1 |
| 3,139,865 | 7/1964 | Aimes | 211/69.5 |
| 3,196,566 | 7/1965 | Littlefield | 335/306 |
| 3,269,528 | 8/1966 | Leedy | 206/818 |
| 3,785,739 | 1/1974 | Hodkin | 335/303 |
| 4,168,129 | 9/1979 | Herrnring | 335/306 |
| 4,414,523 | 11/1983 | Pieters | 335/302 |
| 4,451,811 | 5/1984 | Hoffman | 335/302 |

FOREIGN PATENT DOCUMENTS

| | | | |
|---|---|---|---|
| 1197465 | 6/1959 | France | 211/69.5 |
| 1539160 | 8/1968 | France | 211/69.1 |
| 0961725 | 6/1964 | United Kingdom | 335/303 |

*Primary Examiner*—William Price
*Assistant Examiner*—Jimmy G. Foster
*Attorney, Agent, or Firm*—Beveridge, DeGrandi and Weilacher

[57] ABSTRACT

Magnetic holder device for pens and the like. The device comprises a base provided with a cavity for introducing the front or writing end of a pen; a first annular-shaped permanent magnet is arranged in the base member around the aforesaid cavity, and a second permanent magnet on the pen is situated at a short distance from the tip end of the pen and the annular magnet; the magnetic polarities of the second magnet are orientated in an opposite direction to the polarities of the annular magnet so that the two magnetic fields interact to draw the pen towards the bottom of the base and to laterally support it in an upright position.

7 Claims, 2 Drawing Figures

MAGNETIC PEN HOLDER

BACKGROUND OF THE INVENTION

This invention concerns a magnetic support for pens and the like, which utilizes the interaction between two permanent magnets in order to maintain the pen in an upright position substantially free from any resting or supporting structures whatsoever, in that the pen is kept in equilibrium by opposing magnetic forces, thereby enabling the pen to be easily removed and readily replaced in the pen holder.

SUMMARY OF THE INVENTION

This is achieved by means of a magnetic support for pens and the like, characterized by the fact of comprising a base member provided with a central cavity for inserting the tip or writing end of the pen, a first annular-shaped permanent magnet arranged inside the base member, around and coaxially to the aforesaid central cavity, and a second permanent magnet inside and close to the tip of the pen; when the pen rests with its tip in the cavity in the base member, the second magnet is coaxially arranged close to the annular magnet and has its poles disposed with polarities in the opposite direction to the polarities of the poles of the annular magnet.

With the magnetic pen holder according to this invention, the pen is consequently kept in stable equilibrium by the magnetic forces which prevent the pen from falling sideways and which at the same time tend to push it downwards against the supporting base; the pen consequently protrudes from the supporting base, resting just on its tip, almost as though it were hovering, without any apparent support whatsoever.

BRIEF DESCRIPTION OF THE DRAWINGS

Further features and advantages of the magnetic pen holder, according to the invention, will ensue from the following description, with reference to the examples of the accompanying drawings, in which.

DESCRIPTION OF THE INVENTION

Figure 1:
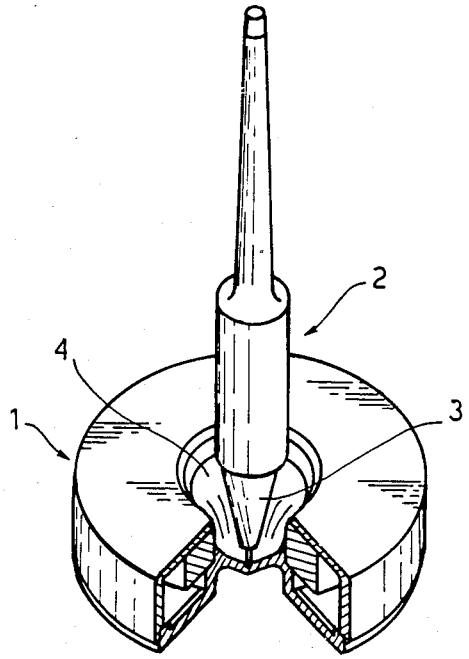
FIG. 1 shows a partially cutaway perspective view of the magnetic support, with the pen inserted.

As shown, the magnetic support comprises a base member, generally indicated by reference 1, designed to support a pen 2, the tip or writing end 3 of which is inserted in a central cavity 4 in the supporting base 1, said pen resting on the bottom of the cavity by its tip alone.

Figure 2:
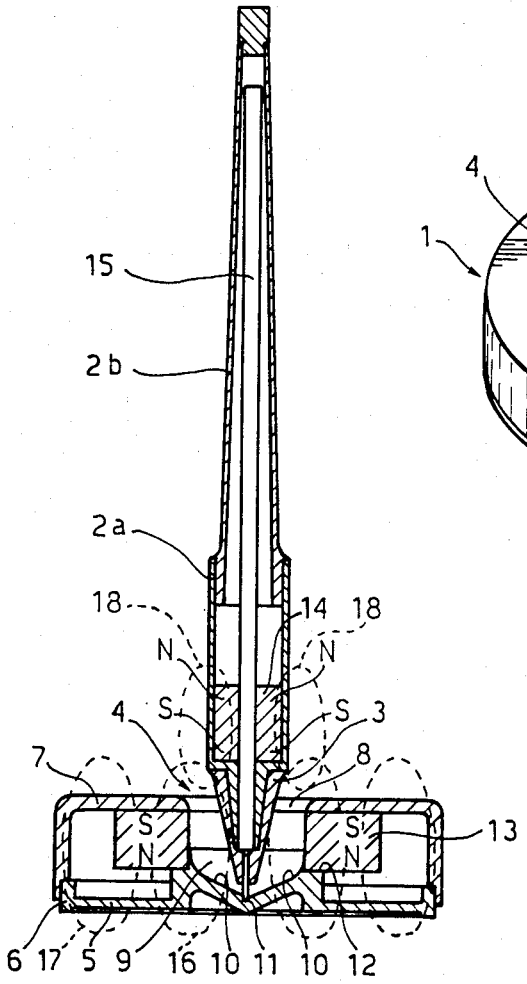
FIG. 2 shows a cross-sectional view of the previous figure, showing the details of one embodiment.

In particular, as shown in cross-section by the example in FIG. 2, the base 1 of the supporting device comprises a bottom element 5 provided with an outer edge 6 onto which is secured a cup-shaped element 7 provided with a central aperture 8 defining the upper edge of the cavity 4 for inserting the tip of the pen. Below the central aperture 8, inside the casing element 7, the bottom 5 is provided with a cone-shaped portion 9, whose peripheral surface is orientated downwards and ends in a small seat 11 in which the writing point of the pen 2 rests.

Outside and around the cone-shaped portion 9 of the bottom element, which together with the aperture 8 in the casing element 7 defines the cavity 4 for inserting the tip of the pen, is an annular ledge 12 which supports a first annular-shaped permanent magnet 13 having its axis of magnetization arranged vertically and coaxial with the aforesaid cavity 4; the polarities of said magnet 13 are thus orientated as shown in the drawing, for example, with the polarity S facing upwards, in correspondence with the upper face of the magnet, whilst the opposite polarity N is orientated downwards on the lower face of the aforementioned magnet.

As the writing end of the pen 2 comes to rest with its tip on only one point 11 on the bottom of the cavity 4, it is advantageous for the aforesaid resting point 11 to be situated at a certain distance below the lower face of the magnet 13, as this permits greater stability of the pen 2 in the vertical position, once inserted into the cavity 4 in the supporting base, whereas it is supported laterally by opposing magnetic forces.

The magnetic supporting device is then completed by a second permanent magnet 14 situated inside the pen 2, close to its tip or front end 3.

The low disposition of the magnet 14, besides keeping the bary-center of the pen as close as possible to the base 1, thus giving greater stability and balance, brings the magnet 14 in the pen close to the magnet 13 in the base 1, so that the two magnetic fields can reciprocally interact in order to keep the pen vertical simply resting on its tip, without any lateral support whatsoever. In order to achieve this, it is necessary, when in the pen supporting condition, for the magnet 14 to be placed coaxially to the magnet 13 and to have its N and S magnetic polarities facing in the opposite direction to the magnetic polarities of the annular magnet 13, as shown in FIG. 2.

The structure of the base 1 and the pen 2 can be of any kind whatsoever, such as for example, as was previously described for the base 1; likewise, in the example shown, the pen 2 may comprise a first lower cylindrical-shaped portion **2*a*, with a cone-shaped end 3, in which the magnet 14 is situated, and an upper portion 2*b* whose neck portion fits into the upper aperture in the cylindrical portion 2*a*** of the pen.

The two pen portions **2*a* and 2*b* should be of a sufficient length for example to contain a normal ink cartridge 15 which passes through the magnet 14**, as shown, and which ends with a writing point.

The working principle of the magnetic device for holding pens and the like is as follows: the annular magnet 13 generates a magnetic field in the direction of the axis of the magnet with flux lines 16 which close inside the central hole and the flux lines 17 which close outside the latter. Likewise, the cylindrical magnet 14 in the pen will generate an external magnetic field orientated like the first, but with opposing polarities, which interact with the magnetic field of the other magnet.

As the magnet 14 in the pen has a smaller external diameter than the internal diameter of the annular magnet 13, the latter will generate a flux tube in which the magnet 14 will be immersed; due to the opposing disposition of the polarities of the two magnetic fields, when the pen magnet 14 is moved axially and downwards towards the annular magnet 13, a point will be reached in which the magnet 14 will tend to be pulled downwards and into the annular magnet 13, until the point of the pen 2 comes to rest on the bottom of the cone-shaped portion 9 of the cavity 4 in the supporting base. The pen will therefore remain in this stable position, under the axial force of attraction of the magnets opposed by the supporting base 1; moreover, the pen 2 will remain in a perfectly vertical position, as a result of the effect of radial repulsion forces which are exerted peripherally between the flux lines of the two magnets; consequently, if the pen should tend to lean to one side or is accidentally knocked, it will not fall due to the fact that the effect of the radial repulsion between the two fields will tend to bring it back to an upright position. Its return to this position is also ensured by the fact that the pen rests on its point below the annular magnet in the base 1, and by the disposition of the magnet 14 which brings the barycenter of the pen as close as possible to its resting or pivoting point.

The dimensions of the magnets and their reciprocal location can be established by experimenting, according to the characteristics of the pen to be supported. Merely by way of example, and as a guide, it is pointed out that, for a ball-point pen of the type shown, approximately 14 cm. in length, an annular magnet 13 was used with an external diameter of approximately 45 mm, an internal diameter of approximately 22 mm, roughly half the external diameter, and a magnet 14 with an external diameter of approximately 11 mm, that is to say, half the internal diameter of the annular magnet. Moreover, the pen magnet 14 was positioned in such a way that the distance L between the upper face of the annular magnet 13 and the lower face of the pen magnet 14 was kept equal to or less than approximately 7 mm; in general, this distance can be expressed as a function of the ratio with the internal diameter D of the magnet 13, with D/L ranging from approximately 2.5 to 3.5. It is understood however that the dimensions shown are given merely as a guide and that they may also differ, according to the various requirements, without however deviating from the principle of the magnetic support for pens and the like, as claimed herein.

What is claimed is:

1. Magnetic supporting device for pens and the like, characterized by the fact that it comprises a pen and a base element, said base element being provided with a cavity for receiving the front end of the pen; a first annular-shaped permanent magnet situated in the base element around and coaxially to the aforesaid cavity, said first magnet having north and south poles for providing a first magnetic field with flux lines; and a second permanent magnet situated close to the front end of the pen, said second magnet having north and south poles for providing a second magnetic field with flux lines; the second magnet having its magnetic polarities oriented in the opposite direction to the polarities of the annular magnet in the supporting base; said pen having a rest position which it occupies when it is supported on said base element; said first and second magnets being located where the flux lines of their magnetic fields interact when the pen is in its rest position to exert an axial force of attraction and a radial force of repulsion, said axial force of attraction having a direction which forces the pen axially against the base member, and said radial force of repulsion having a direction which holds the pen in its rest position.

2. Device as claimed in claim 1, characterized by the fact that the second magnet lies above and at a short distance from the annular magnet when the tip of the pen rests in the cavity of the supporting base.

3. Device as claimed in claim 1, characterized by the fact that the magnet in the pen has a smaller external diameter than the internal diameter of the annular magnet.

4. Device as claimed in claim 3, characterized by the fact that the magnet in the pen has an external diameter equal to approximately half the internal diameter of the annular magnet.

5. Device as claimed in claim 1, characterized by the fact that the ratio between the internal diameter of the annular magnet and the distance existing between the opposing faces of the two magnets ranges from 2.5 to 3.5 approximately.

6. Device as claimed in claim 1, characterized by the fact that the cavity for introducing the pen, in the supporting base, is provided on the bottom with a cone-shaped surface converging downwards.

7. Device as claimed in claim 1, characterized by the fact that the central cavity in the supporting base defines a rest point for supporting the writing tip of the pen, situated on a plane below the annular magnet.

* * * * *